US005203880A

United States Patent [19]

Tselesin

[11] Patent Number: 5,203,880

[45] Date of Patent: Apr. 20, 1993

[54] METHOD AND APPARATUS FOR MAKING ABRASIVE TOOLS

[76] Inventor: Naum N. Tselesin, P.O. Box 52606, Atlanta, Ga. 30355

[21] Appl. No.: 919,040

[22] Filed: Jul. 24, 1992

[51] Int. Cl.[5] ..... B24D 3/00

[52] U.S. Cl. ..... 51/293; 51/298; 51/307; 51/308

[58] Field of Search ..... 51/293, 298, 307, 308

[56] References Cited

U.S. PATENT DOCUMENTS

| | | | |
|---|---|---|---|
| 3,517,464 | 6/1970 | Mattia et al. | 51/293 |
| 3,694,177 | 9/1972 | Vereschagin et al. | 51/293 |
| 3,762,895 | 10/1973 | Keeleric | 51/309 |
| 4,211,294 | 7/1980 | Multakh | 51/309 |
| 4,373,933 | 2/1983 | Grazen | 51/309 |
| 4,737,162 | 4/1988 | Grazen | 51/293 |

*Primary Examiner*—Mark L. Bell
*Assistant Examiner*—Willie J. Thompson
*Attorney, Agent, or Firm*—James B. Middleton

[57] ABSTRACT

A separator is placed between the mold, and a body of matrix material with hard particles being compacted, for forming an abrasive body. The separator may be relatively soft, so some of the hard particles will partially enter the separator during compaction. Subsequent removal of the separator leaves particles protruding through the retaining surface so the abrasive body does not necessarily require dressing. The separator may act as a release agent to facilitate removal of the abrasive body. The separator may also be contoured so the abrasive body will be contoured after compaction. A plurality of separators may be used to provide different functions simultaneously.

15 Claims, 2 Drawing Sheets

METHOD AND APPARATUS FOR MAKING ABRASIVE TOOLS

FIELD OF THE INVENTION

This invention relates generally to the making of abrasive tools, and is more particularly concerned with a method for sintering under pressure with separator means between the material being sintered and the pressure exerting member.

BACKGROUND OF THE INVENTION

A conventional and well known technique for forming abrasive tools is to mix hard particles such as diamonds into a matrix material, and to exert pressure on the mixture while increasing the temperature of the mixture, to a temperature at which the matrix material is sintered. One technique for heating the mixture is to place the mixture between pressure plates, or plungers, formed of electrically conductive material, and to pass an electric current through the plungers and the mixture sufficient to raise the temperature to the necessary extent. In making tools according the these prior art techniques, the plungers are frequently formed of graphite. The graphite is a good conductor of the electrical current; but, if the hard particles protrude from the matrix material during sintering under pressure, the plunger will be damaged. The face of the plunger will have to be dressed, or the graphite portion will have to be replaced before further use If the plunger is formed of a hard metal rather than graphite, it will be understood that dressing the face will be more difficult, and more expensive.

In sintering material under pressure to make abrasive tools, it will be understood that the intent is to have the hard particles substantially embedded within the matrix material so the surface of the plunger will not be marred. Also, of course it is desired to provide a tool having the hard particles either uniformly distributed so the tool will wear evenly during use, or distributed according to a specific tool design to achieve particular cutting functions. If particles protrude from some areas of the surface, but not others, the aggressiveness of the tool will vary between the various areas of the tool, so a tool can be designed to accomplish any desired end.

In view of the above discussed techniques, it will be understood that, after a tool is sintered, the tool must be dressed to "open" the surface of the tool. That is to say, the matrix material must be removed on the working surface of the tool to expose the hard particles. This dressing of the tool is an additional step in the manufacturing process, and increases the total cost of manufacture.

SUMMARY OF THE INVENTION

The present invention provides a separator between compacting means and the matrix material, the separator having a composition such that hard particles at the surface of the matrix material can protrude from the matrix material and enter the separator. The separator may extend completely across the intended working surface, or may cover selected areas of the abrasive body being formed. As a result, hard particles may protrude from the matrix material generally uniformly over the entire working surface, or may protrude from the matrix material only in the selected areas.

The present invention contemplates the use of an electrically conductive separator, in which case the usual technique for direct electrically heating the material can be utilized with no change. The invention also contemplates the use of separators that are electrically insulative. In this case, the electric current can be passed through a mold in which the material is being formed. Optionally, the current may also pass through an embedded screen or the like substantially at the surface of the body.

Instead of resistance heating, other methods of heating such as radiant or convection heating can be used, with both electrically conductive and electrically insulative separators. Also, self-fusing materials may be used to hold the hard particles in combination with separators.

In other embodiments of the invention, the separator can be shaped to cause a corresponding shape of the body being formed without the necessity for shaping the compacting means. Further, the separator can contour, or shape, the compacting means.

BRIEF DESCRIPTION OF THE DRAWINGS

These and other features and advantages of the present invention will become apparent from consideration of the following specification when take in conjunction with the accompanying drawings in which.

DETAILED DESCRIPTION OF THE EMBODIMENTS

Figure 1:
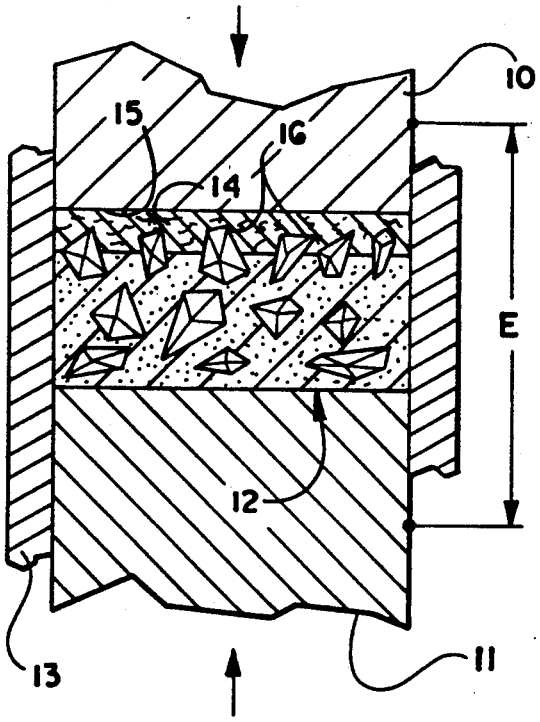
FIG. 1 is a diametrical cross-sectional view showing the formation of an abrasive body in accordance with the present invention.

Referring now more particularly to the drawings, and to those embodiments of the invention here presented by way of illustration, FIG. 1 shows a pair of opposed plungers 10 and 11 within a mold 13, the plungers 10 and 11 having therebetween a quantity of matrix material 12. A plurality of hard particles is distributed throughout the matrix material 12. Those skilled in the art will understand that, of the two plungers 10 and 11, both may be movable, or only one may be movable while the other acts as a stationary platen. The only important fact is that there is relative movement between the two plungers 10 and 11, and the invention is not to be restricted to any particular arrangement so long as there is some means to exert pressure on the matrix material 12. Also, of course, the plungers 10 and 11 may be used without the mold 13. Those skilled in the art will also recognize that self-fusing materials may be used in static molds. The pressure created by natural expansion of the material during the exothermic reaction will create sufficient pressure to compact the material, and the walls of the static mold will have the same effect as the moving plungers 10 and 11.

It is also possible to utilize fluid pressure, either liquid or gas, to exert the desired compacting force on the body being sintered. For example, a mold or other container for the matrix material may be placed into an autoclave, and the autoclave can both provide the sintering heat, and provide the compacting pressure. Alternatively, a gas can be admitted to a mold such as the mold 13, the gas providing reducing or inert atmosphere. The plungers 10 and 11, and/or the mold 13, may be provided with openings to admit the gas.

As shown in FIG. 1, there is a separator 14 between the matrix material 12 and the plunger 10. The separator 14 is of uniform thickness across the face 15 of the plunger 10. The separator 14 may be formed of a sheet material for convenience, though molded shapes and the like may also be used.

In the arrangement shown in FIG. 1 of the drawings, the separator 14 is an electrically conductive material, which may be a graphite powder, graphite fibers or graphite paper. The powders and fibers may be used with a binder to allow formation of the separators by pre-forming and/or pre-compacting. The graphite paper is commercially available, for example for use as gaskets, from Flexicarb, Inc., Deer Park, Tex.

The primary feature of the separator 14 is that it is soft enough that, during compaction of the body 12 of matrix material, some of the hard particles can penetrate the separator, as indicated at 16. To say that the separator 14 is "soft" is of course relatively speaking. The hard particles may be diamonds, metal carbides or the like that are extremely hard. As a result, many different materials can be used as the separator 14. Also, one might use a softer material as the separator if the hard particles should extend to a great depth in the separator, and a harder material if the hard particles should extend to only a short depth in the separator.

As shown in FIG. 1, since the separator 14 is of an electrically conductive material, a current can be passed through the assembly from plunger 10 to plunger 11 by a voltage applied as indicated at E. After the matrix material has been properly compacted, then heated, the plungers 10 and 11 will be separated and the resulting piece removed. In general, the separator 14 will tend to adhere to the body 12, or the resulting abrasive body; however, since the separator may be made of graphite paper or the like, the separator 14 is easily removed by blasting with water jets, by brushing, scraping or the like. Thus, the body 12 will have its working face already "open" subject only to easy removal of the separator 14. Optionally, two separators can be put on over the other. In this case, one separator may stick to the plunger while another sticks to the material, but the separators do not adhere strongly to each other and are easily separated.

Figure 2:
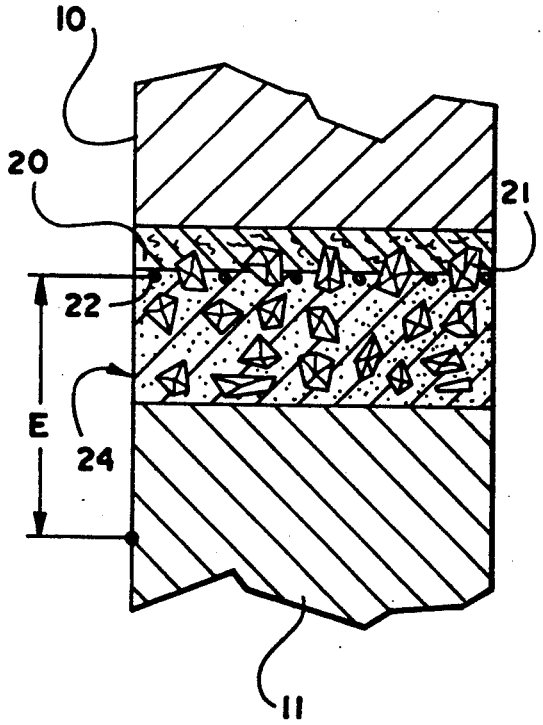
FIG. 2 is a view similar to FIG. 1, but showing an embedded screen for use as an electrical terminal, and/or as a means for spacing hard particles.

Attention is next directed to FIG. 2 of the drawings. Here it will be seen that there are two plungers 10 and 11 with a body of matrix material 24 therebetween. It should be understood that the arrangement shown in FIG. 2 and in subsequent figures of the drawings would include a mold such as the mold 13, and the mold has been omitted for simplicity and clarity. A plurality of hard particles is dispersed throughout the body 24, and a separator 20 extends over the face 21 of the plunger 10. In FIG. 2 it is contemplated that the separator 20 is made of an electrically insulative material, and this material may be, for example, ordinary paper. Since the separator 20 covers the entire face 21 of the plunger 10, electric current cannot be passed between the plungers 10 and 11 as in FIG. 1. Thus, an electrically conductive screen 22 is received between the body 24 and the separator 20. It will be understood that the screen 22 will be urged into the matrix material during compaction, which is as shown in FIG. 2 of the drawings. A voltage can then be placed between the screen 22 and the plunger 11 as indicated at E.

Those skilled in the art will understand that a metallic screen can be used if the matrix material is electrically conductive, or the matrix itself can act as an electrical terminal if the material is electrically conductive. On the other hand, different heating techniques can be used so that the screen 22 can be non-conductive. By way of example, the mold, such as the mold 13, can receive the electric current and provide heat to the body 24 through conduction. Many other combinations will suggest themselves to those skilled in the art.

As is disclosed in the U.S. Pat. No. 5,049,165, the screen 22 may also be used to reinforce the surface of the abrasive tool, and/or to align the hard particles. The one screen 22 may be used, or a plurality of screens may be distributed in the body 24 as taught in the above mentioned patent. Also the screens, such as the screen 22, may be made of a low melting metal that will fuse at sintering temperature, or of a high melting metal that will remain intact during sintering.

The hard particles at the surface of the body 24 can enter the separator 20. If the separator 20 is made of ordinary paper, the sintering temperature will cause the paper to burn. As a result, when the body 24 is removed from between the plungers 10 and 11, the burnt paper separator 20 will be very ease to remove, as by an air blast or light brushing. When the separator 20 has been removed, the hard particles at the surface of the body 24 will be open so no further dressing is required.

Figure 3:
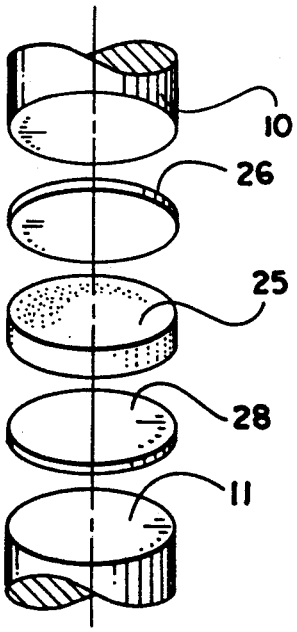
FIG. 3 is an exploded perspective view, on a reduced scale, showing separators on both sides of the body being formed.

With the above description in mind, attention is directed to FIG. 3 of the drawings. The plungers 10 and 11 are shown with a body 25 therebetween. There are here shown two separators 26 and 28 covering the faces of the two plungers 10 and 11. The result may be that both the upper and the lower faces of the body 25 will have hard particles extending therefrom; however, one of the separators 26 and 28 may be of a hard material that prevents entry of particles. In that event, only one surface of the body 25 will have protruding hard particles.

Figure 4:
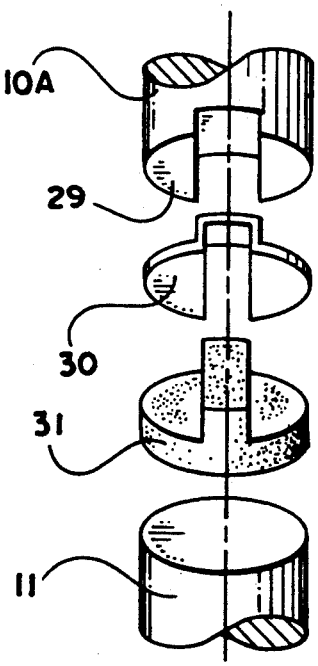
FIGS. 4–7 are views similar to FIG. 3 showing shaping of the surfaces of the body.

FIG. 4 discloses a plunger 10A having a contoured surface 29, and a separator 30 will cover the face 29. Because the separator is made of a flexible material, the separator can easily conform to variously shaped surfaces. In the example shown in FIG. 4, the body 31 has an upper surface shaped as a complement to the face 29; and, since the separator 30 covers the face 29, the shaped surface of the body 31 will have hard particles extending therefrom. The separator may be pre-shaped to conform to the face 29, or may be shaped during compression.

Figure 5:
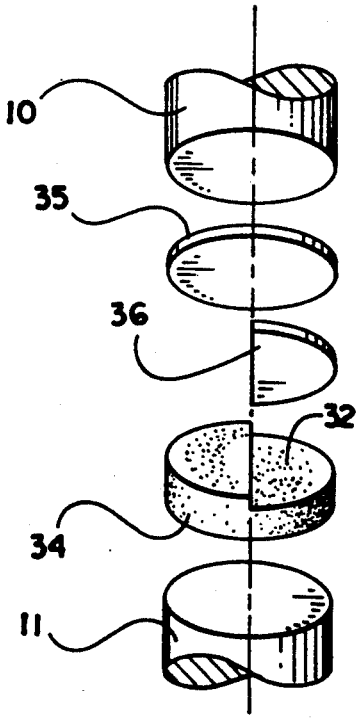

FIG. 5 illustrates the creation of a shaped surface 32 on the body 34, the shaping being from use of separators in accordance with the present invention. In FIG. 5, the plungers 10 and 11 have flat faces as is common. On the face of the plunger 10, a separator 35 covers the entire face; then, a second separator 36 partially covers the separator 35. The result is a stepped surface that is applied to the body of matrix material during compaction, forming the contoured surface 32 of the body 34.

Figure 6:
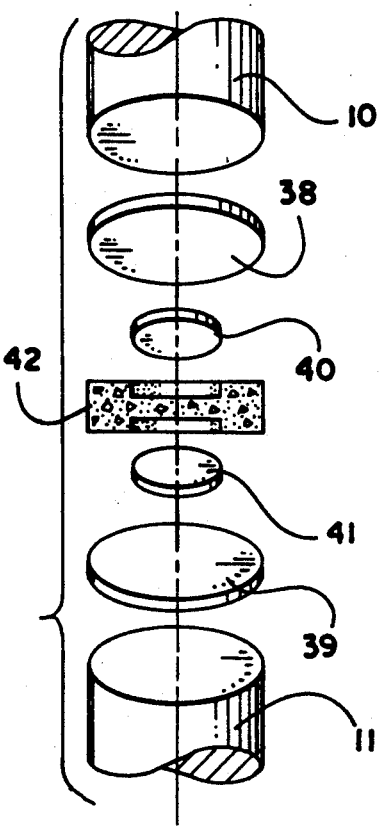

Another example of shaping the body through use of separators is shown in FIG. 6. Here, the faces of the plungers 10 and 11 are covered by separators 38 and 39; and, centrally of the separators 38 and 39, there are smaller separators 40 and 41. The body 42 formed thereby is shown in cross-section, and it will be seen that the body includes a central web with a thicker rim. Both sides of the body 42 may have hard particles protruding therefrom because of the use of the separators in accordance with the present invention.

Figure 7:
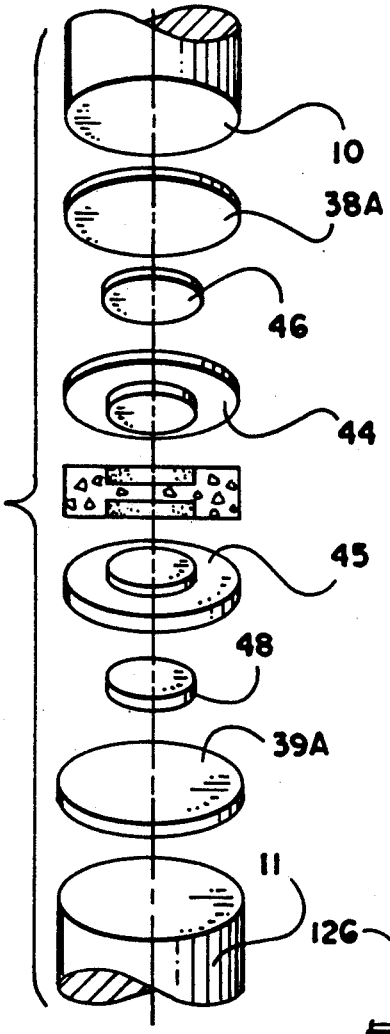

FIG. 7 is similar to FIG. 6. The plungers 10 and 11 are the same, the body 42A is the same, and the separators 38A and 39A are the same as the separators 38 and 39. The difference is that, in FIG. 7, the second separators designated at 44 and 45 are the same size as the separators 38A and 39A. To cause the contour, there are buttons 46 and 48 inserted between the separators as shown. Thus, when the plungers 10 and 11 exert pressure on the materials, the buttons 46 and 48 will cause deformation of the matrix material, and of the separators 44 and 45, to shape the body 42A as shown.

Figure 8:
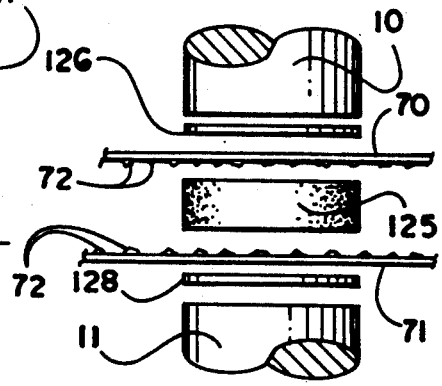
FIG. 8 is a side elevational view showing a modified form of the invention.

FIG. 8 of the drawings illustrates a body 125 between plungers 10 and 11, and separators 126 and 128 covering the respective plungers 10 and 11. In this embodiment of the invention it will be understood that the body 125 may or may not have hard particles distributed therein. Also, the body 125 may be formed of virtually any sinterable material, including polymeric materials that are thermoplastic so particles will fuse under heat.

The unique feature disclosed in FIG. 8 of the drawings is the use of webs and/or adhesive strips 70 and 71 having a plurality of hard particles 72 adhered thereto. The web itself may disintegrate at sintering temperature, or may act as a release agent, leaving the hard particles in the body 125. If the body 125 does not include hard particles, the particles on the webs 70 and 71 will provide the only abrasive particles for the body. If the body 125 does include hard particles, the webs 70 and 71 will provide the initial, open surface for the tool through the presence of the separators 126 and 128.

Figure 9:
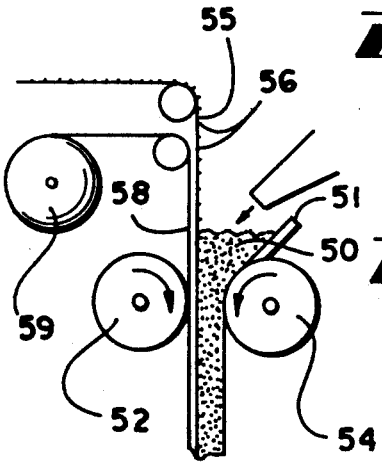
FIG. 9 is a schematic illustration showing the compacting of a powder by rollers in accordance with the present invention; and, FIG. 10 is a schematic illustration showing the compacting of a pre-form by rollers.

A different technique for compacting a matrix material is illustrated in FIG. 9 of the drawings. Matrix material 50 in powder form is fed into a hopper 51, the hopper 51 directing the material 50 between compaction rolls 52 and 54. The matrix material 50 may or may not have hard particles distributed therein.

On at least one surface of the matrix material 50, hard particles are applied by means of an adhesive strip 55. The strip 55 may be made of paper, plastic film or virtually any other sheet material. Hard particles 56 are adhered to the sheet, and this strip 55 is fed into the hopper 51 at one side thereof as shown.

A separator 5 is placed between the compacting roll 52 and the strip 55 carrying the hard particles. Thus, the above described method for causing hard particles to protrude from the surface of the matrix material 5 is carried out. In the embodiment of the invention shown in FIG. 9, the separator 58 is supplied from a roll of the material indicated at 59, so that separator 58 can be supplied continuously along with the matrix material 50.

Figure 10:
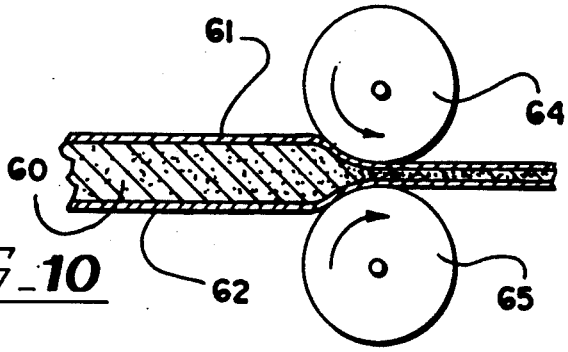

Roll compaction can also be used on a pre-form as is shown in FIG. 10. A pre-form 60 is sandwiched between separators 61 and 62, and the assembly is passed between compaction rolls 64 and 65. Hard particles may have already been pressed into the surface of the pre-form 60, or they may be fed simultaneously using an adhesive strip such as that shown in FIG. 9. In either case, hard particles may protrude from the surfaces of the matrix material because of the separators 61 and 62. It should also be noticed that the separators 61 and 62 are compacted by the rolls 64 and 65.

In view of the foregoing description, those skilled in the art will understand that the separator of the present invention may be formed of paper, graphite, silicon carbide or other powders and fibers; it may be made of ceramics or minerals such as mica, or numerous other materials that are relatively soft as described herein.

In addition to allowing the hard particles to protrude from the matrix and enter the separator, the separator can facilitate separation of the sintered tool from the plungers 10 and 11. If hard particles are not to protrude from a surface, a separator of a hard and tough material can be used on that surface. Thus, metallic sheet, for example, can be used as a separator between the matrix material and a graphite plunger to prevent damage to the graphite plunger. Also, an additional separator of paper or the like may be used between the metallic separator and the graphite plunger to facilitate separation of the steel separator from the graphite plunger.

It should therefore be understood by those skilled in the art that the separator of the present invention can be variously formed and variously utilized. The separator may be formed from an existing sheet material, or may be molded by compacting particles, fibers or chips. The separator may provide an open surface by allowing hard particles to penetrate the separator, or the separator may simply conform to the surface of the plunger, or the separator may, through differing thicknesses, cause an uneven surface on the body being formed. Further, the separator may be electrically anisotropic to assist in heating, then retaining heat.

As is discussed above, the separator may be formed of any of regular papers which are soft enough to allow hard particles to enter the separator. Also, paper burns at sintering temperature, so the paper will be burnt, rendering removal quite easy. Alternatively, the separator may be formed of graphite paper as described above, or of ceramic paper. A commercially available ceramic paper is intended as insulation, and is sold under the trademark "Fiberfrax" by Carborundum Company, Insulation Division, Niagara Falls, N.Y. The graphite or ceramic paper will endure the heat and can serve to facilitate separation of the sintered body from the plungers. If desired, a plurality of layers of separators may be used. For example, a graphite separator may adhere to a graphite plunger, but a ceramic paper separator may adhere to the body being sintered and release from the graphite. Many such combinations are possible, including conventional spray-on or paint-on mold releases. Any release medium may be between the plunger and a separator, and/or between the separator and the body being sintered.

The separator of the present invention can be formed of particles, fibers, chips or the like. By way of example, a fusible powder or the like can be made as a pre-form. The pre-form may adhere together due to heat only, or a binder consisting of a glue, or polymeric binder or the like may be used. In making such a separator, the pre-form can be made as dense as desired. Also, one might use ceramic particles, or chips, and compact the material to a great density. Alternatively, one might use graphite particles, or fibers, and compact only slightly. The high density separator may prevent the entry of hard particles, and the low density may allow entry of hard particles. One might also use a pre-form that is further compacted during compaction and sintering of the body to be sintered.

In the formation of a sintered body having a contoured surface, the use of the separator can be extremely important. While the separator may allow an open surface to be formed automatically, when a complex surface is to be formed, the separator will be easy to disintegrate, providing effectively a mold release for the sintered body. As is mentioned above, the separator itself may create the contoured surface to shape the sintered body. This technique is simpler and generally less expensive than shaping the plunger.

Those skilled in the art will understand that, when the sintering heat is achieved by passing an electric current through the assembly as indicated in FIGS. 1 and 2, proper heating is dependent on sufficient current flow, and proper insulation to hold the heat. With this in mind, an anisotropic material such as graphite paper may be used as the separator. If graphite paper has a higher electrical conductivity in a direction perpendicular to the compaction force, it assists in uniform distribution of heat across the body being sintered.

The above and foregoing discussion has been concerned with opening the surface of a body to be sintered, the hard particles to be exposed being those already mixed into the matrix material. It is also possible to add a layer of hard particles to the surface of a body of matrix material. The layer to be added may be the only hard particles in the body or may be added to a plurality of particles already mixed into the body.

It is known in the prior art that diamonds can be aligned with a magnetic field, but there is very little that can be done to maintain the orientation. According to the present invention, a plurality of diamonds can be oriented by means of a magnetic field; and while the diamonds are held by the magnetic field, the diamonds can be adhered to a sheet such as the sheet 55. It should be recognized that the sheet 55 may also be the separator, so the sheet carrying the hard particles may act as the separator during compaction and sintering.

Having a sheet such as the sheet 55, a layer, or an additional layer, of hard particles can be inserted as desired. The use of such a sheet is illustrated in FIGS. 8 and 9, but those skilled in the art will understand that any of the arrangements illustrated may have an additional layer of hard particles added by a sheet 55. Further, the sheet 55 may have diamonds adhered thereto as discussed above, or may have any other hard particles adhered thereto, whether or not the particles have any particular orientation.

It will therefore be understood that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In the method for making a body of abrasive material wherein a plurality of hard particles is embedded in a matrix material for retaining said hard particles during use, said method including the steps of placing said matrix material in a mold means, providing said plurality of hard particles adjacent to at least one surface of said body, exerting compacting forces against said body with said mold means, and raising the temperature of said body to a sintering temperature during the said step of exerting compacting forces against said body, the improvement comprising the step of placing a separator between said mold and said body prior to the said step of exerting compacting forces against said body.

2. In the method as claimed in claim 1, the further improvement wherein said separator is relatively soft so that said hard particles will be partially urged into said separator during the said step of exerting compacting forces against said body.

3. In the method as claimed in claim 2, the improvement wherein said separator disintegrates at a temperature below said sintering temperature.

4. In the method as claimed in claim 3, the improvement wherein said separator is paper.

5. In the method as claimed in claim 2, the improvement wherein said separator consists of at least one material selected from the group consisting of silicon carbide, graphite particles, graphite fiber, ceramic particles and ceramic chips.

6. In the method as claimed in claim 5, the further improvement including the step of adding a binder to said separator.

7. In the method as claimed in claim 2, the further improvement wherein at least some of said hard particles are provided immediately prior to said step of exerting compacting forces against said body.

8. In the method as claimed in claim 7, the improvement wherein some of said hard particles are mixed into said matrix material prior to the said step of providing said plurality of hard particles adjacent to at least one surface.

9. In the method as claimed in claim 1, wherein said mold means has a contoured surface, the improvement wherein said separator is flexible, and said separator is caused to conform to the contours of said mold means during the said step of exerting compacting forces against said body.

10. In the method as claimed in claim 1, the improvement wherein said separator has a contoured surface, and including the step of creating a contoured surface on said body of abrasive material during the said step of exerting compacting forces against said body.

11. In the method as claimed in claim 1, wherein the said step of exerting compacting forces against said body comprises the step of urging two opposed compacting means against said body, and said step of placing a separator between said mold means and said body comprises placing a separator between each of said opposed compacting means and said body.

12. In the method as claimed in claim 11, the improvement wherein one separator is relatively soft so that said hard particles will be partially urged into said separator during said step of exerting compacting forces against said body.

13. In the method as claimed in claim 12, the improvement wherein said separators are of different densities so that said hard particles are urged into said one separator to a greater degree of penetration than into the other separator.

14. In the method as claimed in claim 13, the improvement wherein said separators consist of the same material.

15. In the method as claimed in claim 1, the improvement wherein the said step of placing a separator between said mold means and said body comprises placing a compressible material between said mold means and said body, and compacting said compressible material during the said step of exerting compacting forces against said body for forming said separator.

* * * * *

US005203880B1

REEXAMINATION CERTIFICATE (2697th)

United States Patent [19]

Tselesin

[11] B1 5,203,880

[45] Certificate Issued Oct. 17, 1995

[54] METHOD AND APPARATUS FOR MAKING ABRASIVE TOOLS

[75] Inventor: Naum N. Tselesin, Atlanta, Ga.

[73] Assignee: Ultimate Abrasive Systems, Inc., Atlanta, Ga.

Reexamination Request
No. 90/003,406, Apr. 18, 1994

Reexamination Certificate for:

| | |
|---|---|
| Patent No.: | **5,203,880** |
| Issued: | **Apr. 20, 1993** |
| Appl. No.: | **919,040** |
| Filed: | **Jul. 24, 1992** |

[51] Int. Cl.[6] ..... B24D 3/00

[52] U.S. Cl. ..... 51/293; 51/296; 51/298; 51/307; 51/308; 51/309

[58] Field of Search ..... 51/293, 295, 307–309

[56] References Cited

U.S. PATENT DOCUMENTS

| | | | |
|---|---|---|---|
| 2,268,663 | 1/1942 | Kuzmick | 51/206 |
| 3,906,684 | 9/1975 | Marshall et al. | 51/295 |
| 5,131,924 | 7/1992 | Wiand | 51/293 |
| 5,203,881 | 4/1992 | Wiand | 51/293 |

FOREIGN PATENT DOCUMENTS

| | | | |
|---|---|---|---|
| 0086086A2 | 8/1983 | European Pat. Off. | E21B 10/48 |
| 49-103269 | 9/1974 | Japan | B22F 3/02 |

*Primary Examiner*—Deborah Jones

[57] ABSTRACT

A separator is placed between the mold, and a body of matrix material with hard particles being compacted, for forming an abrasive body. The separator may be relatively soft, so some of the hard particles will partially enter the separator during compaction. Subsequent removal of the separator leaves particles protruding through the retaining surface so the abrasive body does not necessarily require dressing. The separator may act as a release agent to facilitate removal of the abrasive body. The separator may also be contoured so the abrasive body will be contoured after compaction. A plurality of separators may be used to provide different functions simultaneously.

27 Claims,

REEXAMINATION CERTIFICATE ISSUED UNDER 35 U.S.C. 307 THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 3 are cancelled.

Claims 1 and 4–15 are determined to be patentable as amended.

New claims 16–29 are added and determined to be patentable.

1. In [the] *a* method for making a body of abrasive material wherein a plurality of hard particles is embedded in a *sintered* matrix material for retaining said hard particles during use, said method including the steps of placing [said] *sinterable* matrix material in a mold means *having a pressure exerting member*, providing [said] *a* plurality of hard particles adjacent to at least one surface of said [body] *matrix material*, exerting compacting forces against said [body] *matrix material* with said [mold means] *said pressure exerting member*, and raising the temperature of said [body] *matrix material* to a sintering temperature during the said step of exerting compacting forcesagainst said [body] *matrix material*, the improvement comprising the step of placing a separator between said [mold] *pressure exerting member* and said [body] *one surface of said matrix material* prior to [the] said step of exerting compacting forces against said [body] *matrix material wherein said separator is relatively soft so that said hard particles will be partially urged into said separator during said step of exerting compacting forces against said matrix material and is of an electrically conductive material, and wherein said separator is separate from and is not integral with said pressure exerting member and is thereafter removed from said body following sintering.*

4. [In the] *The* method as claimed in claim [3] *28*, [improvement] wherein said *electrically insulative* separator is paper.

5. [In the] *The* method as claimed in claim [2, the improvement] *1*, wherein said *electrically conductive* separator consists of at least one material selected from the group consisting of silicon carbide, graphite particles, graphite fiber, [ceramic particles and ceramic chips] *and graphite paper.*

6. [In the] *The* method as claimed in claim 5, [the further improvement including the step of adding a binder to] *wherein* said *electrically conductive* separator *material includes a binder.*

7. [In the] *The* method as claimed in claim [2, the further improvement] *1*, wherein at least some of said hard particles are provided immediately prior to said step of exerting compacting forces against said [body] *sinterable matrix material.*

8. [In the] *The* method as claimed in claim [7] *1*, [the improvement] wherein some of said hard particles are mixed into said matrix material prior to the said step of providing said plurality of hard particles adjacent to at least one surface.

9. [In the] *The* method as claimed in claim 1, wherein said [mold means] *pressure exerting member* has a contoured surface, [the improvement] *and* wherein said separator is flexible[,] and [said separator] is caused to conform to the [contours] *contoured surface* of said [mold means] *pressure exerting member* during the said step of exerting compacting forces against said [body] *matrix material wherein a contoured surface is formed on said body of abrasive material.*

10. [In the] *The* method as claimed in claim 1, [the improvement] wherein said separator has a contoured surface[,] and [including the step of creating] *forms* a contoured surface on said body of abrasive material during the said step of exerting compacting forces against said [body] *matrix material.*

11. [In the] *The* method as claimed in claim 1, wherein the said step of exerting compacting forces against said [body] *matrix material* comprises the step of urging [two] *an* opposed [compacting means] *pressure exerting member* against [said body] *a second surface of the matrix material opposite from said one surface*, and [said] *the* step of placing a separator between said [mold means] *pressure exerting member* and said [body] *matrix material* comprises *also* placing [a] *another electrically conductive* separator between [each of] said opposed [compacting means] *pressure exerting member* and said [body] *second surface of said matrix material.*

12. [In the] *The* method as claimed in claim 11, [the improvement] wherein [one] *hard particles are provided adjacent said second surface of said matrix material and said another* separator is relatively soft so that said hard particles will be partially urged into said *another* separator during said step of exerting compacting forces against said [body] *matrix material.*

13. [In the] *The* method as claimed in claim 12, [the improvement] wherein said separators are of different densities so that said hard particles are urged into [said] one separator to a greater degree of penetration than into the other separator.

14. [In the] *The* method as claimed in claim [13] *12*, [the improvement] wherein said separators consist of the same material.

15. [In the] *The* method as claimed in claim 1, [the improvement] wherein the [said] step of placing a separator between said [mold means] *pressure exerting member* and said [body] *matrix material* comprises placing [a] compressible *particulate* material between said [mold means] *pressure exerting member* and said [body] *matrix material*, and compacting said compressible *particulate* material during the said step of exerting compacting forces against said [body] *matrix material* for forming said separator.

*16. The method as claimed in claim 15, wherein a binder is added to said compressible particulate material prior to compacting said material.*

*17. The method as claimed in claim 5, wherein the electrically conductive separator is graphite paper.*

*18. The method as claimed in claim 17, wherein the graphite paper is an anisotropic material.*

*19. The method as claimed in claim 1, wherein the separator is an electrically conductive anisotropic material.*

*20. The method as claimed in claim 1, wherein a screen is positioned between said one surface of said sinterable matrix material and said separator and is urged into said sinterable matrix material during said step of exerting compacting forces against said sinterable matrix material.*

*21. The method as claimed in claim 1, wherein said separator has a plurality of said hard particles adhering to one of its surfaces, and the step of providing said plurality of hard particles adjacent to at least one surface of said matrix material comprises contacting said one surface of the separator with said one surface of said matrix material and thereafter exerting said compacting forces at said sintering temperature.*

*22. The method as claimed in claim 21, wherein said plurality of hard particles is oriented on said one surface of said separator prior to adherence of said particles on said one surface of said separator.*

*23. The method as claimed in claim 1, wherein the temperature is raised to a sintering temperature by passing an electric current through said pressure exerting member, separator, and matrix material.*

*24. The method as claimed in claim 1, wherein the step of providing hard particles adjacent to at least one surface of said matrix material comprises positioning at least one sheet carrying said hard particles between said one surface of the matrix material and the separator.*

*25. The method as claimed in claim 24, wherein the particles are adhered to one surface of the sheet.*

*26. The method as claimed in claim 1, wherein the separator is preformed from a mass of particulate material.*

*27. The method as claimed in claim 26, wherein a binder is added to said mass to preform said separator.*

*28. In a method for making a body of abrasive material wherein a plurality of hard particles is embedded in a sintered matrix material for retaining said hard particles during use, said method including the steps of placing sinterable matrix material in a mold means having a pressure exerting member, providing a plurality of hard particles adjacent to at least one surface of said matrix material, exerting compacting forces against said matrix material with said pressure exerting member, and raising the temperature of said matrix material to a sintering temperature during the said step of exerting compacting forces against said matrix material, the improvement comprising the step of placing a separator between said pressure exerting member and said one surface of said matrix material prior to said step of exerting compacting forces against said matrix material wherein said separator is relatively soft so that said hard particles will be partially urged into said separator during said step of exerting compacting forces against said matrix material and is of an electrically insulative material that disintegrates below said sintering temperature and wherein said separator is separate from and is not integral with said pressure exerting member.*

*29. In a method for making a body of abrasive material wherein a plurality of hard particles is embedded in a sintered matrix material for retaining said hard particles during use, said method including the steps of placing sinterable matrix material in a mold means having a pressure exerting member, providing a plurality of hard particles adjacent to at least one surface of said matrix material, exerting compacting forces against said matrix material with said pressure exerting member, and raising the temperature of said matrix material to a sintering temperature during the said step of exerting compacting forces against said matrix material, the improvement comprising the step of placing a separator between said pressure exerting member and said one surface of said matrix material prior to said step of exerting compacting forces against said matrix material wherein said separator is relatively soft so that said hard particles will be partially urged into the said separator during said step of exerting compacting forces against said matrix material and is of an electrically insulative material selected from the group consisting of ceramic particles, ceramic paper and ceramic chips, and wherein said separator is separate from and is not integral with said pressure exerting member.*

* * * * *